US005667095A

United States Patent [19]

Riedel et al.

[11] Patent Number: 5,667,095

[45] Date of Patent: Sep. 16, 1997

[54] CONTAINER FOR A CONTAINER DISPOSAL ARRANGEMENT

[75] Inventors: Norbert Riedel, Rheinberg; Ludger Riedel, Xanten, both of Germany

[73] Assignee: Riedel und Söhne oHg, Kamp-Lintfort, Germany

[21] Appl. No.: 443,321

[22] Filed: May 17, 1995

[30] Foreign Application Priority Data

May 17, 1994 [DE] Germany ..... 44 17 156.0

[51] Int. Cl.[6] ..... B65D 1/42; B65D 6/34; B65D 8/08

[52] U.S. Cl. ..... 220/640; 220/1.5

[58] Field of Search ..... 220/640, 660, 220/1.5

[56] References Cited

U.S. PATENT DOCUMENTS

| | | | |
|---|---|---|---|
| 1,075,643 | 10/1913 | Gowen | 220/640 X |
| 1,627,282 | 5/1927 | Gran | 220/640 X |
| 1,934,220 | 11/1933 | Willson | 220/640 |
| 3,089,725 | 5/1963 | Bertels | 220/640 X |
| 3,347,412 | 10/1967 | McKinney | 220/1.5 X |
| 3,670,912 | 6/1972 | Dunbar . | |
| 4,872,574 | 10/1989 | Lam | 220/1.5 |

*Primary Examiner*—Steven M. Pollard
*Attorney, Agent, or Firm*—Watson Cole Stevens Davis, P.L.L.C.

[57] ABSTRACT

A container 1 for a container disposal arrangement with a mobile crane arranged on a truck with a hydraulically-operated grappler for the container, whereby the container 1 is designed as a rectangle when viewed from above, open on top, can be closed if necessary with a cover and has a floor 6 underneath and whereby the side walls 2, 3 of the container 1 extend toward the bottom conically and inwardly and a collar 7 with walls 8, 9 extending parallel to one another is provided on the upper edge of the container 1, is designed so that several functional hollow bodies 14, 15, 16, 17 are provided in the area of the collar 7, that the upper and lower edges 13, 12 of the collar 7 are each tilted, and that at least one stopper section 21 for lifting tools is provided in the area of the collar 7.

10 Claims, 5 Drawing Sheets

I
V
VIII
IV
1
2
3
4
5
6
7
8
9
10
11
12
18
19
22
24
26

CONTAINER FOR A CONTAINER DISPOSAL ARRANGEMENT

BACKGROUND OF THE INVENTION

1. Field of the Invention

The invention relates to a container for a container disposal arrangement with a mobile crane arranged on a truck with a generally hydraulically-operated grappler for the container, whereby the container is designed as a rectangle when viewed from the top, open on top, can be closed if necessary with a cover and has a floor underneath, and whereby the side walls of the container extend toward the bottom conically and inwardly and a collar with walls extending parallel to one another is provided on the upper edge of the container.

2. The Prior Art

A container which is designed as a rectangle from a top view and whose side walls taper downwardly and inwardly conically is disclosed in DE-PS 40 08 619. This known container has a floor and is open on top. On the upper edge of the container a collar is provided whose walls extend in parallel to one another. In two opposing sides of the collar claw engaging pockets are provided in which claws engage a grappler on a mobile crane for lifting, tipping and lowering the container.

In the German publication "Glucklauf" 1986, No. 6, pg. 415, a mobile crane is portrayed which has a digging arm, on the outer end of which a hydraulically operated grappler is arranged with which the handling of trolleys used in mining is possible. With this device the trolleys can be raised from the floor, tipped and emptied, as well as finally set on the floor again, and namely on a certain point or swivelling range of the crane.

A universal container stack and loading device for stacking and transport of large containers with a weight of 20 to 40 tons is known from DE-OS 17 81 464. This device is designated for the handling of sea and large space containers. It is used for the transport of bulk goods and for the handling of material in a limited local area within a certain period of use. A transport of this large space container on public streets is not provided nor is it allowable.

A tipping device for cranes is known from DE-OS 30 23 894 which has two rotating arms and a tipping device for picking up and tipping containers, in particular for tipping trolleys and cars used in mining. This tipping device has a crossbeam connected on the lifting tool of the crane and stands are arranged shiftably on the bevelled crossbeam, on the free ends of which the rotating arms are positioned. On the rotating arms, which are designed on their pick-up ends in a bow-shaped, pick-up plates are arranged, which are manufactured from elastic formable plastic. The pick-up plates are screwed onto the rotating arms, so that they are easily exchanged and can be adapted by the tipping device to different sizes and shapes of containers to be picked-up.

A grappler and related container is known from U.S. Pat. No. 3,670,912 whereby the grappler is suspended on a chain hoist or a stockyard crane. On both outer ends of a pair of telescoping arms two clamping jaws are arranged, on the lower ends of which are roughly triangle shaped claw is arranged such that it can rotate. A toggle lever is connected with its one end with the claw secure against turning and attached with its other end to the piston rod of a hydraulic cylinder such that it can turn. By extending and retracting the piston rod of the hydraulic cylinder, the claw is turned by a certain amount.

The related container has two container walls facing one another and running parallel to one another, on which each two angle sections are fastened which converge in toward the upper edge of the container and the two legs form an isosceles triangle. At approximately the middle height of the container a horizontally arranged floor section is provided between the two angle sections. The floor section and the two upper areas of the angle sections include a triangular engaging space which opens to the outside and which has the form of a claw.

To be able to move the containers, the claws must always be latched between the angle sections and the floor section. A simple fastening under carrying frames or under a collar is not possible, nor is engaging in a stopper eye of a stopper section. Since the opposing container walls extend parallel to one another, these containers can be only stacked on one another, but never stacked in one another.

SUMMARY OF THE INVENTION

The invention has the object of creating a container of the type discussed above which can be transported independently of the system that runs the engaging device that grasps it, on which additional devices such as for example a shredder of similar device can be attached and which centers itself when stacked.

The object is achieved by providing several functional hollow bodies in the area of the collar, by the upper and lower edges of the collar being tilted, and by providing at least one stopper section for the lifting tool in the area of the collar.

In this way one achieves a container of the type discussed above, whose collar is strongly reinforced. Thus the possibility exists to arrange additional units, as for example a shredder or similar item, on this strongly reinforced collar. In addition, the container centers itself when stacked.

In a further embodiment of the invention a pipe or similar item can be provided in the area of the corner of the container. Such a pipe serves to stiffen the collar of the container. For this a vertically arranged pipe can be provided suitably in the corner between the upper and lower edge of the collar.

It is further advantageous that the upper edge and the lower edge each be tilted downward and outward. The container can also be designed so that on the upper edge of the collar a stopper section is provided on two opposing walls. In the area of the stopper section the walls of the collar are conical, but run less conically downward and inward than the walls of the container.

The invention relates further to a pipe with an attachment device provided in the pipe, for example for the insertion in the corner of the collar of the container. This pipe is designed in the invention so that at least one upper clamping pipe and at least one lower clamping pipe are provided in the pipe, which lie on common slanted surfaces facing one another and are shiftable toward one another on these, and that a pressure disk is provided with a bore hole on the upper end of the pipe, through which a tension device is conducted. By pulling on the tension device, adjacent clamping pipes in each case shift on their common surface along this surface slanted toward one another and come in this way to a solid unit against the inner wall of the outer pipe. In this way the clamping pipes are clamped inside the outer pipe so that a tight connection exists in the axial direction.

For simple or normal application cases it suffices when an upper clamping pipe and a lower clamping pipe are provided in the pipe, which lie facing one another on a common surface and are shiftable toward one another on this surface, that the lower clamping pipe has a threaded piece within internal threading on its lower end and that on the upper end of the pipe a pressure disk is provided with a bore hole, through which a screw bolt is conducted, which is screwed in the threaded piece and has a screw head on the outer end.

The pipe can be suitably designed so that a joint is provided on two adjacent pressure disks provided on the upper edge of the container, in which a top is fastened so that it can swivel.

It is further advantageous to construct the pipe so that arrangements are provided on at least two adjacent pressure disks, with which additional devices, for example a shredder, can be arranged on the container. In addition, an outer container surrounding the container can be provided which is suitably equipped with a leakage system.

The invention will be explained in detail in the following with the help of the exemplary embodiment depicted in the drawings.

DETAILED DESCRIPTION OF THE PREFERRED EMBODIMENT

Figure 2:
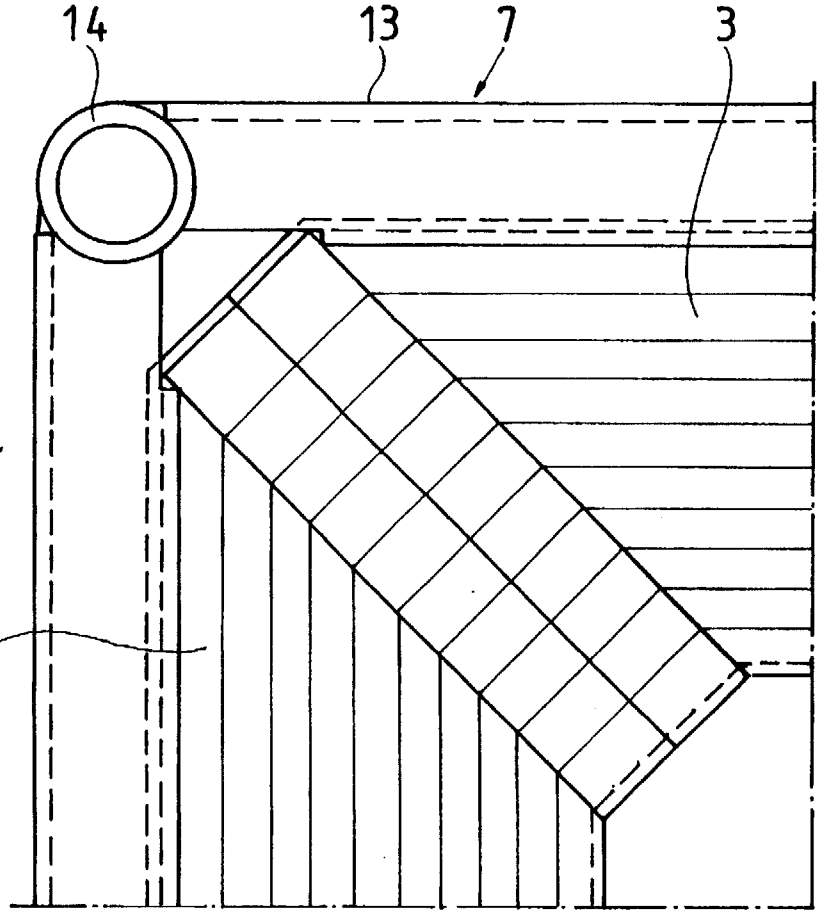
FIG. 2 shows an enlarged detail of the corner area II in FIG. 1.
Figure 1:
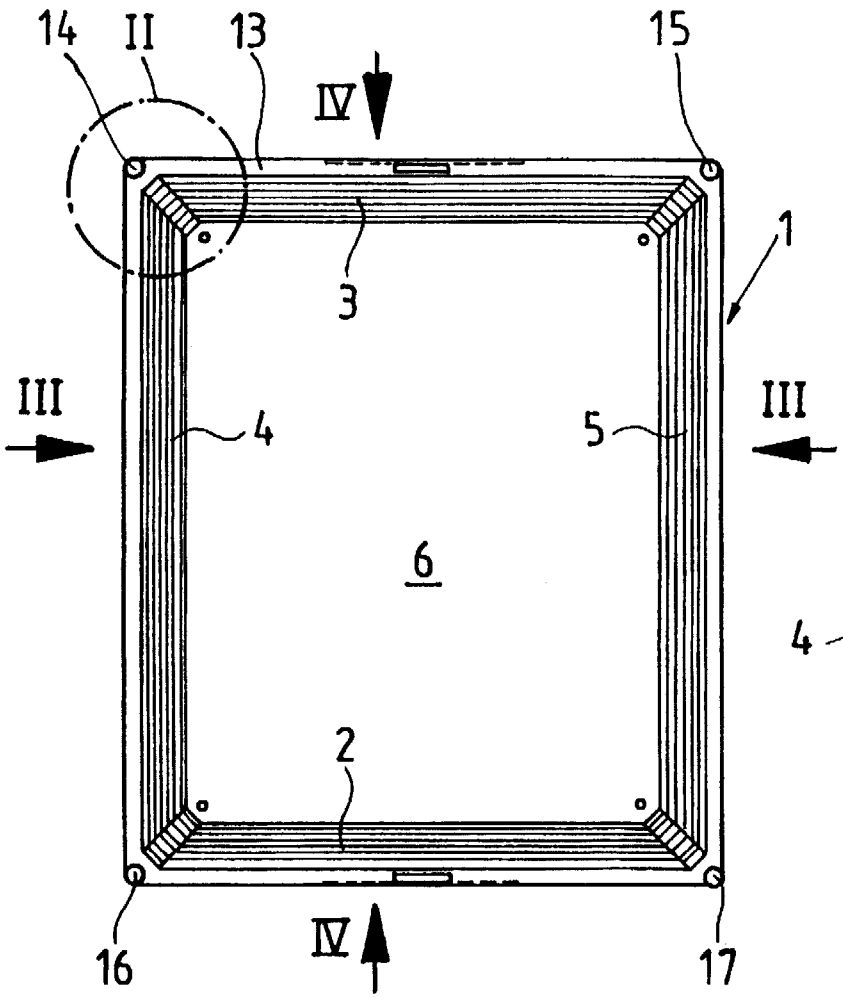
FIG. 1 shows a top view of a container designed in accordance with the invention.

The container 1 depicted in the drawings is rectangular when viewed from above and tapers downwardly, i.e., it has opposing walls 2, 3 and 4, 5 which slant towards one another in a downward direction. At a lower end the container has a floor 6, while at its upper end the container is open. On the upper edge of the container a collar 7 is provided which has walls 8, 9 and 10, 11 extending parallel to one another. The collar 7 extends somewhat over the walls of the container on all sides with its lower edge 12.

On the upper edge 13 of the collar 7 vertically running pipes 14, 15, 16, 17 are provided in the corners of the collar 7. Through these pipes 14, 15, 16, 17 a significant stiffening of the collar 7 is possible. In addition, an aid to manufacturing is established in that no miter joints must be produced. In addition, the borders do not need to be broken because the pipes 14, 15, 16, 17 already represent a rounding or breaking of the borders. In addition, it is possible to position additional devices, for example a shredder or similar device, on the pipes 14, 15, 16, 17.

The pipes 14, 15, 16, 17 do not need to be arranged exactly in the corners of the collar 7 as is depicted, but rather it suffices for reinforcing the collar when the pipes are arranged in the area of the corner, possibly even somewhere in the area of the outer side.

The collar 7 has a bevelling 18 on its upper end which is tilted for example, at an angle of 15° . Likewise, a surface 19 extending at a slant with the same angle of 15° is provided on the lower end of the collar 7. In this way the advantage is achieved that the individual container can center itself when stacked. Furthermore, they center themselves for instance on the cover laid on the container. In addition, water only runs outwardly, in any case not into the container. Finally, this edge makes a sealing possible in vacuum operations.

Figures 3, 4:
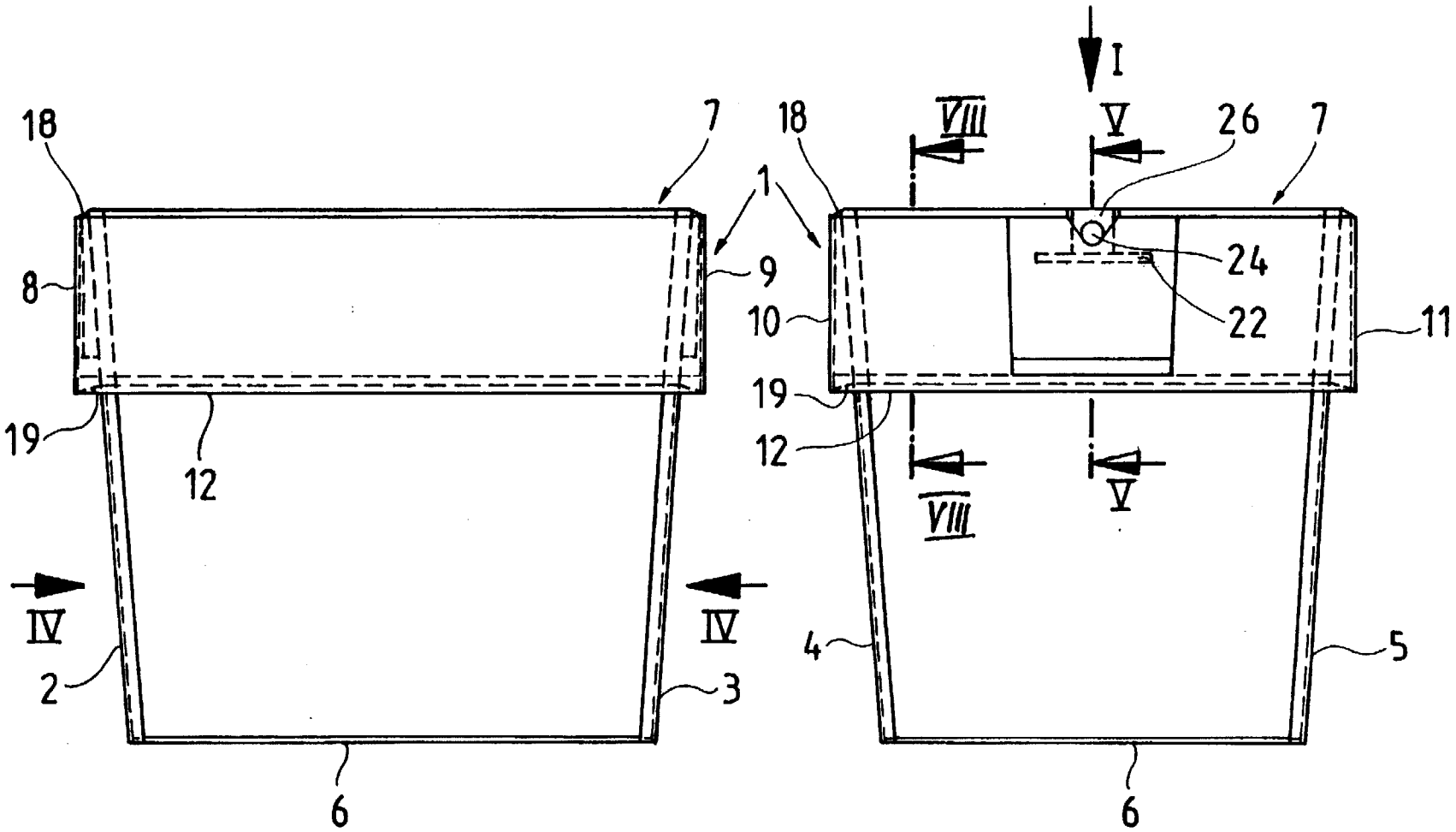
FIG. 3 shows a side view of the container in accordance with FIG. 1 in the direction of the arrow III in FIG. 1.
FIG. 4 shows a side view of the container in accordance with FIG. 1 in the direction of arrow IV in FIG. 1.
Figure 5:
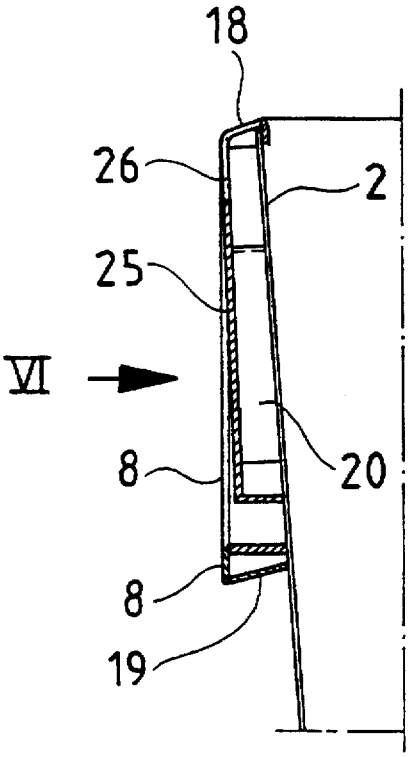
FIG. 5 shows a section along line V—V in FIG. 4.
Figure 6:
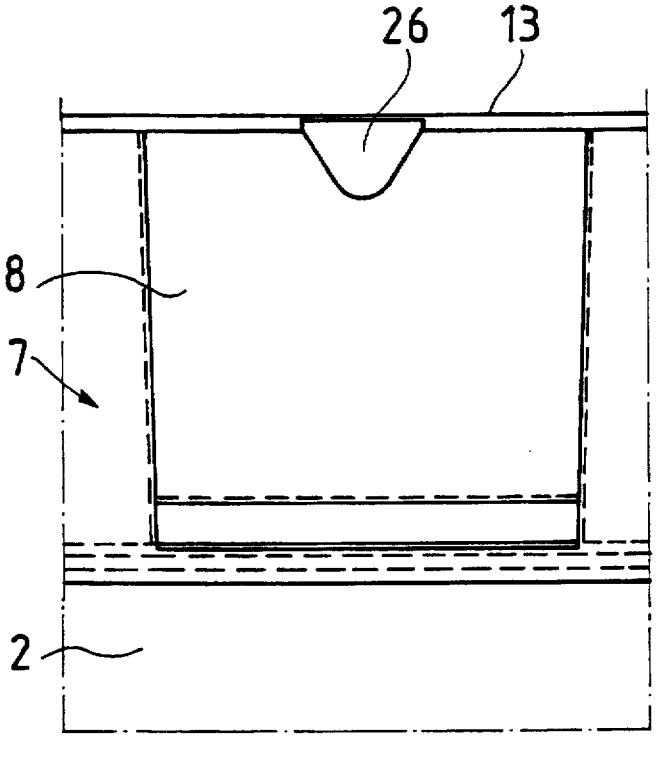
FIG. 6 shows a view of FIG. 5 in the direction of arrow VI.
Figure 7:
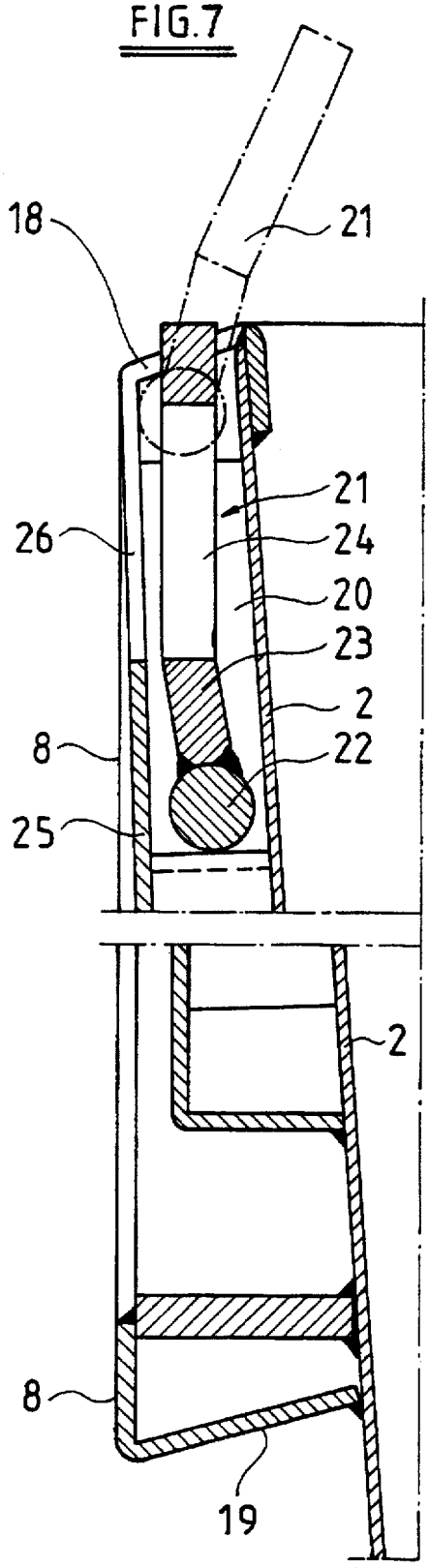
FIG. 7 shows an enlarged depiction of FIG. 5, cut away in the middle section.
Figure 8:
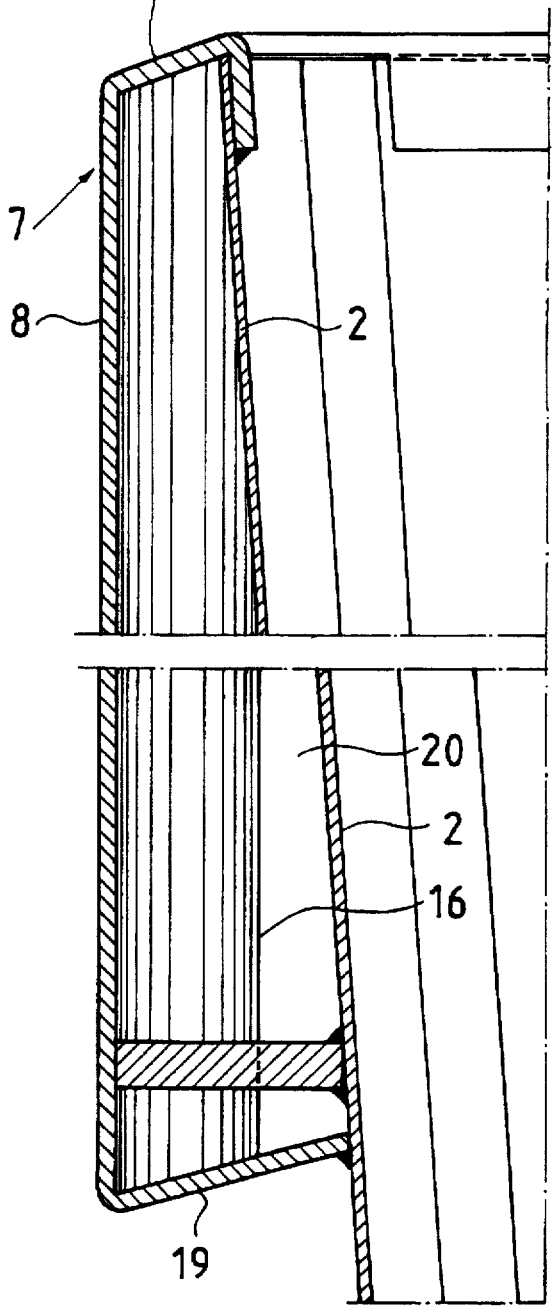
FIG. 8 shows a section along line VIII—VIII in FIG. 4.

As seen in FIGS. 4, 5 and 7, between the wall 2 of the container and the wall 8 of the collar a space 20 is formed. In both spaces associated with the walls 8 and 9 a stopper section 21 is provided, which comprises a stop pin 22 and a plate 23 with a bore hole 24. At the height of the bore hole 24 an engaging opening 26, through which the lifting tool of a crane engages for lifting the container, is provided in the outer wall 25 which runs at a slight slant downwards facing the wall 8 in the area of the stopper section 21.

In FIG. 7 the position of the stopper section 21 when pulled out of the area 20 is shown in phantom.

Figure 9:
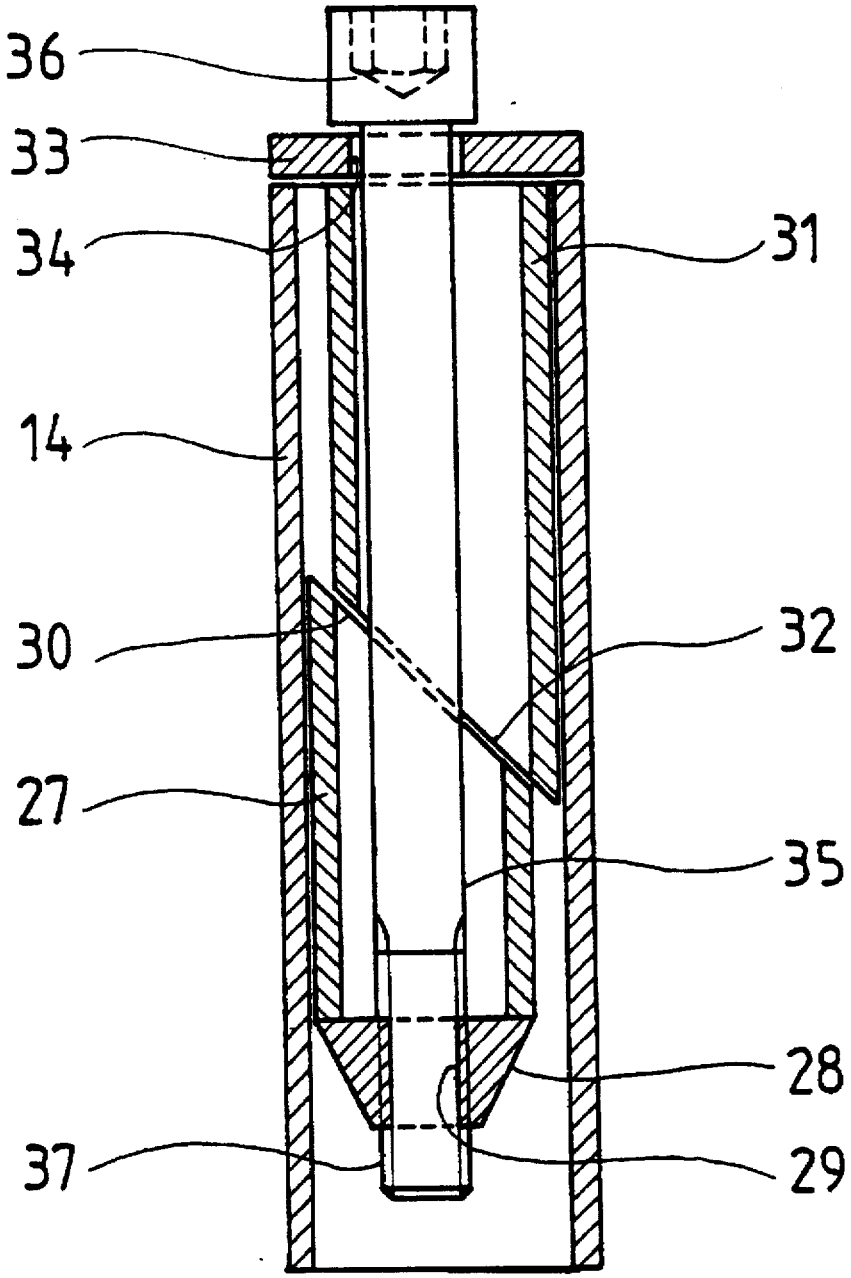
FIG. 9 shows a longitudinal section through a pipe according to the invention with a clamping device provided in the pipe.

As is shown in FIG. 9, a lower pipe piece 27 is provided in a pipe, perhaps in pipe 14, which has a threaded piece 28 with internal threading 29 on its lower end and whose upper end presents a slanted surface 30.

Above the lower pipe 27 an upper pipe 31 is provided whose lower end presents a slanted surface 32, whereby the slanted surfaces 30 and 32 are tilted at the same angle. On the upper end of the pipe 14 or the upper pipe 31 a pressure disk 33 is provided which has a bore hole 34 through which a screw bolt 35 penetrates, on the upper end of which a screw head 36 is provided. On the lower end of the screw bolt 35 an outer threading 37 is provided, which fits in the inner threading 29. To be able to attach a swivelling axis for the arrangement of a cover on the container on two adjacent pipes 14, the screw 35 is tightened so that the lower pipe piece 27, as is shown in the depicted example, lies to the left against the inner wall of the pipe 14 and the upper pipe piece 31 lies accordingly to the right against the inner wall of the pipe 14. With the appropriately strongly tightened screw, the clamping effect between the lower pipe piece 27 and the inner surface of the pipe 14 on one side as well as between the upper pipe piece 31 and the inner surface of the pipe 14 on the other side is so strong that a shifting of the lower pipe piece 27 and the upper pipe piece 31 within the pipe 14 does not occur.

We claim:

1. A container for a container disposal assembly, said container having a rectangular shape as seen from above and including a rectangular floor; first and second pairs of side walls which taper towards one another as they extend from upper edges at an open top of said container downwardly to said floor; a collar which defines a first portion that is inclined downwardly and outwardly from the upper edge of each adjacent side wall, a second portion that extends downwardly from each first portion, said second portions of said collar adjacent opposing side walls extending in parallel with one another, and a third portion which is inclined upwardly from a lower edge of each second portion to the adjacent side wall, said collar including a plurality of reinforcing tubular members which extend between said first and third portions thereof; and a lifting element positioned between the second portion of said collar and an adjacent side wall for gripping and lifting of said container by a crane.

2. A container as defined in claim 1, wherein a said reinforcing tubular member is located at each corner of said collar.

3. A container as defined in claim 1, including a separate said lifting element positioned between the second portions of said collar and opposite side walls of said container.

4. A container as defined in claim 3, wherein opposite said second portions of the collar taper towards one another but at a lessor taper than the adjacent side walls.

5. A container as defined in claim 1, wherein in the area of the stopper section (21) the walls (8, 9, 10, 11) of the collar (7) run conically, although less conically than the walls (2, 3, 4, 5) of the container (1) downwardly and inwardly.

6. A container as defined in claim 1, including an outer container surrounding the container.

7. A container as defined in claim 6, wherein the outer container is equipped with a leakage system.

8. A container as defined in claim 1, wherein said tubular members comprise pipes, at least one of which includes an outer pipe; an upper clamping pipe and a lower clamping pipe located in the outer pipe, said upper and lower clamping pipes defining slanted surfaces facing one another, such that said upper and lower clamping pipes are shiftable toward one another on said slanted surfaces; a pressure disk with a bore hole located on an upper end of the outer pipe, and a tension device which extends through the bore hole.

9. A container as defined in claim 8, wherein the lower clamping pipe (27) has a threaded piece (28) with internal threading (29) on a lower end thereof and wherein said tension device is a screw bolt (35) which extends through said bore hole to a lower end which is screwed in the threaded piece (35) and has a screw head (36) on an upper end thereof.

10. A container as defined in claim 9, including a joint provided at the upper end of two adjacent pipe assemblies for supporting a container cover.

* * * * *